US009784052B2

(12) United States Patent
Ellis et al.

(10) Patent No.: US 9,784,052 B2
(45) Date of Patent: Oct. 10, 2017

(54) ENHANCED RAM-STYLE RISER TENSIONER CYLINDER

(71) Applicant: Dril-Quip, Inc., Houston, TX (US)

(72) Inventors: Fife B. Ellis, Houston, TX (US); Steven M. Hafernik, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 14/946,377

(22) Filed: Nov. 19, 2015

(65) Prior Publication Data

US 2016/0145951 A1 May 26, 2016

Related U.S. Application Data

(60) Provisional application No. 62/082,989, filed on Nov. 21, 2014.

(51) Int. Cl.
*E21B 19/00* (2006.01)
*F15B 1/04* (2006.01)

(52) U.S. Cl.
CPC ..... *E21B 19/006* (2013.01); *F15B 1/04* (2013.01)

(58) Field of Classification Search
USPC ..... 166/355; 405/224.4
See application file for complete search history.

(56) References Cited

U.S. PATENT DOCUMENTS

| | | | | |
|---|---|---|---|---|
| 7,131,922 | B2 | 11/2006 | Williams et al. | |
| 7,819,195 | B2 | 10/2010 | Ellis | |
| 7,823,646 | B2 | 11/2010 | Ellis et al. | |
| 2006/0108121 | A1* | 5/2006 | Ellis | E21B 19/002 166/367 |
| 2014/0202327 | A1* | 7/2014 | Ellis | E21B 19/006 92/143 |

* cited by examiner

*Primary Examiner* — Kyle Armstrong
(74) *Attorney, Agent, or Firm* — Baker Botts L.L.P.

(57) ABSTRACT

In accordance with embodiments of the present disclosure, a ram-style riser tensioner cylinder assembly includes an outer cylinder barrel and an inner rod barrel disposed within and extending in a first direction from the outer cylinder barrel. The cylinder assembly also includes a high pressure seal disposed along a sliding interface between an end of the inner rod barrel and an inner wall of the outer cylinder barrel. In addition, the cylinder assembly includes a cap coupled to an end of the inner rod barrel extending from the outer cylinder barrel, and a fluid reservoir disposed in the cap. The fluid reservoir may be used to store and communicate fluid from the fluid reservoir to the high pressure seal for lubricating the seal.

19 Claims, 5 Drawing Sheets

ENHANCED RAM-STYLE RISER TENSIONER CYLINDER

CROSS-REFERENCE TO RELATED APPLICATIONS

The present application is a non-provisional patent application of U.S. provisional application Ser. No. 62/082,989, entitled "Enhanced Ram-Style Riser Tensioner Cylinder", filed on Nov. 21, 2014.

TECHNICAL FIELD

The present disclosure relates generally to riser tensioners for use on floating platforms and, more particularly, to an improved ram-style riser tensioner cylinder.

BACKGROUND

Various types of riser tensioners have been devised for use in the oil and gas industry. These tensioners help to maintain a desired tension on a riser extending between a subsea oil well and a surface (e.g., floating) drilling or production platform. Ram-style riser tensioners are often used to provide tension to risers used in spar and tension leg platform (TLP) applications. Ram-style riser tensioners may also be used as wireline tensioners in applications with marine drilling risers. Ram-style tensioners include hydro-pneumatic cylinders used to maintain a nearly constant tension on production risers or drilling risers as the floating platform moves in the ocean due to waves, current, and other factors.

In conventional ram-style tensioners, the cylinders typically include a cylinder barrel and a rod barrel that are able to slide, sweep, or stroke relative to one another to lengthen or compress the cylinder. Seals are placed between the barrels at their ends to prevent high pressure fluid from escaping the cylinder, to lubricate and enable the barrels to sweep relative to each other. The hydro-pneumatic cylinders are often filled with hydraulic fluid or oil to keep the seals lubricated, while compressed air or nitrogen is used as a gas spring to maintain tension in the riser. The cylinders are typically connected to an external gas accumulator, which is sized to provide a spring constant within a range that is conducive to the riser design.

Some applications for ram-style riser tensioners (e.g., spar and marine drilling riser applications) tend to produce long strokes on the cylinder compared to other applications (e.g., TLP applications). Thus, spar and marine drilling riser tensioners often utilize large sources of compressed air or nitrogen to maintain a sufficiently soft system during the long cylinder strokes. The swept volume in these cylinders can be quite large, often exceeding 200 gallons. Large volumes of hydraulic fluid are desirable for maintaining the seals on these long-stroking cylinders, since the fluid volume must have space to flow as the cylinder compresses. This fluid is generally contained within the cylinder and/or an accumulator, and large accumulators are often used to provide this volume of fluid. Unfortunately, large accumulators can take up a large amount of deck space and add undesirable weight to the cylinder assembly.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers'specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to an enhanced ram-style riser tensioner cylinder. In accordance with embodiments of the present disclosure, the tensioner cylinder includes an outer cylinder barrel and an inner rod barrel disposed within and extending in a first direction from the outer cylinder barrel. The cylinder also includes a high pressure seal disposed along a sliding interface between an end of the inner rod barrel and an inner wall of the outer cylinder barrel. In addition, the cylinder includes an end cap (e.g., top cap) coupled to an end of the inner rod barrel extending from the outer cylinder barrel, and a fluid reservoir disposed in the end cap. The fluid reservoir may be used to store and communicate fluid from the fluid reservoir to the high pressure seal for lubricating the high pressure seal.

The disclosed ram-style riser tensioner cylinder assembly is designed to store lubricating fluid within an end cap of the cylinder assembly, and to maintain a pressure of the fluid reservoir at approximately the same pressure as gas being stored in an internal accumulator of the cylinder. To accomplish this, some embodiments may include a piston that is open to the fluid reservoir on one side and to the pressurized gas of the internal accumulator on the opposite side. The piston may push the lubrication fluid from the reservoir through a fluid communication tube into the high pressure seal toward the bottom of the cylinder, in response to the cylinder being compressed. In other embodiments, the end cap may include a relatively small pressure communication port disposed between a port open to the pressurized gas and the fluid reservoir. Other arrangements may be utilized in other embodiments as well, as described in detail below. The disclosed cylinder assembly may provide an efficient use of space within the cylinder. In addition, the fluid reservoir may be readily accessible to operators, making it relatively easy to refill when the lubrication fluid store runs low.

Figure 1:
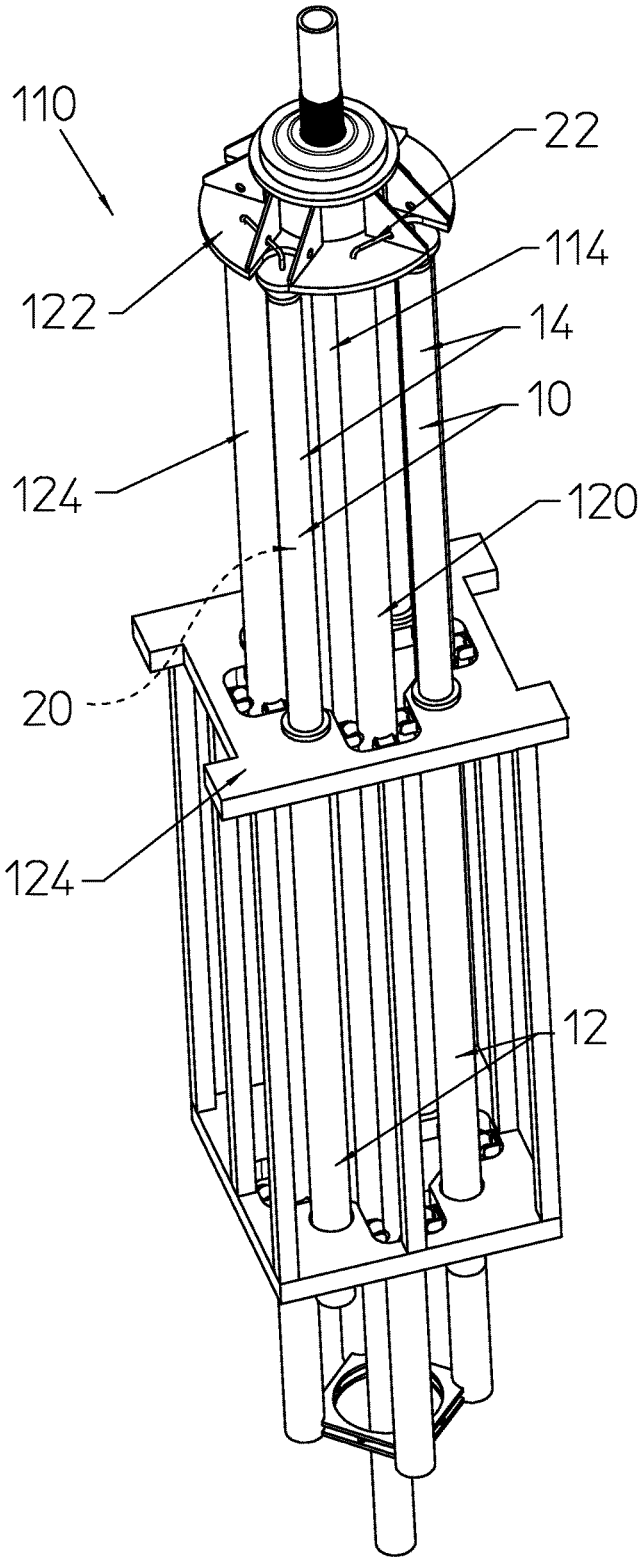
FIG. 1 is a perspective view of a ram-style riser tensioner, in accordance with an embodiment of the present disclosure.

Turning now to the drawings, FIG. 1 illustrates a ram-style tensioner 110 that uses a plurality of hydro-pneumatic cylinders 10 to maintain a desired tension on a riser 114. The riser 114 may generally be coupled between a floating platform and a subsea well device. Each cylinder 10 may include an outer cylinder barrel 12 and an inner rod barrel 14 disposed partially in the cylinder barrel 12. The rod barrel 14 is designed to be stroked relative to the cylinder barrel 12 to lengthen or compress the cylinder 10 in response to movement of the floating platform relative to the subsea well device.

The tensioner 110 may include a plurality of gas accumulators to provide a desired amount of gas for maintaining a desired tension on the riser 114 as the cylinders 10 are stroked. As illustrated, the primary gas accumulators may be internal volumes 20 of gas within the cylinder barrel 12 and/or the rod barrel 14 of each cylinder 10. Each cylinder 10 may be maintained in a certain range of tensions by appropriately sizing the corresponding gas accumulator 20. This sizing of the accumulator 20 may be determined based on a desired stroke and stiffness for the cylinder 10.

Figure 5:
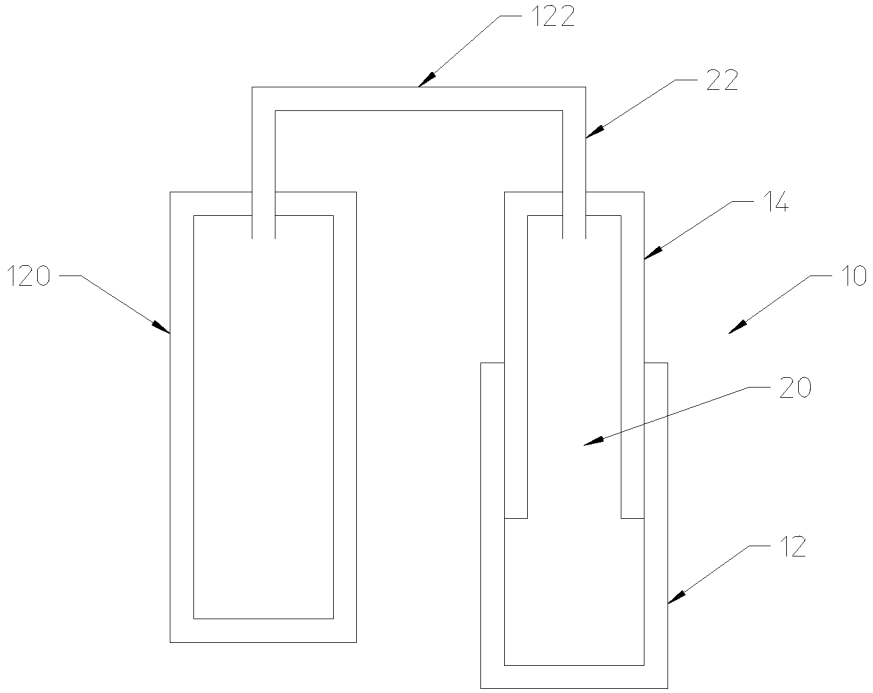
FIG. 5 is a schematic diagram of a cylinder with an internal gas volume connected to an external accumulator via a manifold, in accordance with an embodiment of the present disclosure.

In some embodiments, the amount of pressurized gas needed to maintain the tension in the riser 114 as the cylinder 10 strokes may exceed the volume available in the internal as volume 20 of the cylinder 10. Thus, the tensioner 110 may include an external accumulator 120 for each cylinder 10 that is manifolded to the appropriate cylinder 10 to provide the desired gas volume. An example of the external accumulator 120 and a corresponding manifold 122 for connecting the external accumulator 120 to the cylinder gas volume 20 are illustrated schematically in FIG. 5. As shown, the manifold 122 may include ports for routing gas between the external accumulator 120 and the internal accumulator 20 of a given cylinder 10.

The ram-style tensioner 110 is generally coupled to a floating platform (not shown) where drilling and production operations are performed. As the floating platform moves in response to waves, current, and other factors, the cylinders 10 of the tensioner 110 lengthen or compress while maintaining a desired tension on the riser 114. In some embodiments, the cylinders 10 may be mounted either directly into the hull of the floating platform, or to a structural frame 124 that mounts to the hull. As illustrated in FIG. 1, the cylinder barrel 12 of the cylinder 10 may be coupled to the structural frame 124, while the rod barrel 14 is allowed to stroke up and down to move the riser 114 relative to the structural frame 124 (and floating platform).

Figure 2:
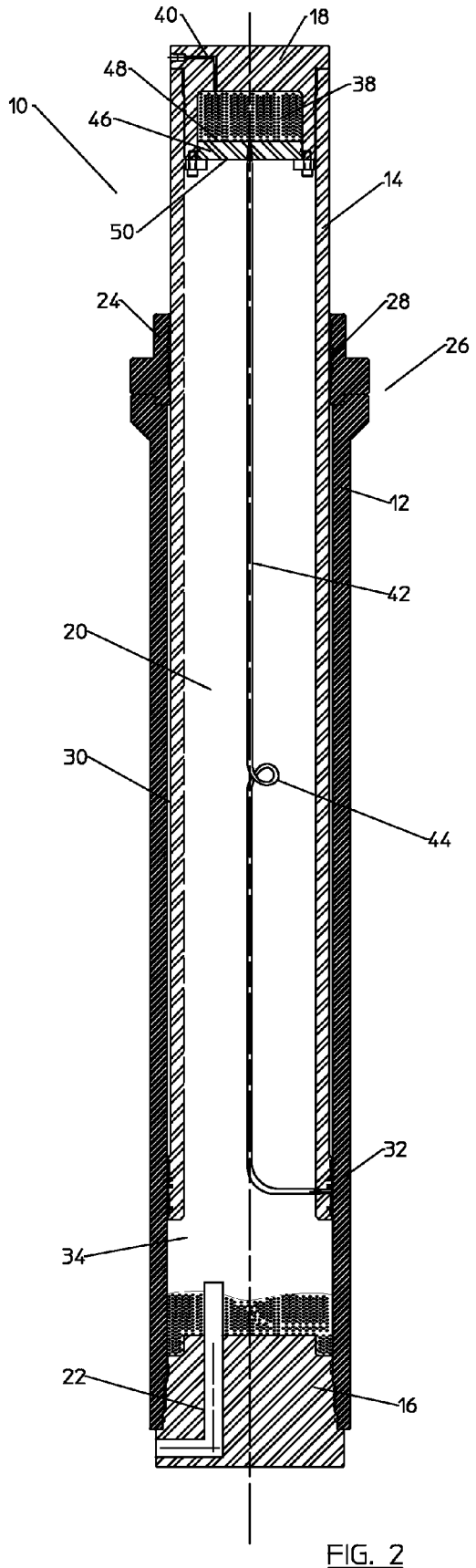
FIG. 2 is a cross sectional view of a cylinder for use in a riser tensioner, in accordance with an embodiment of the present disclosure.
Figure 3:
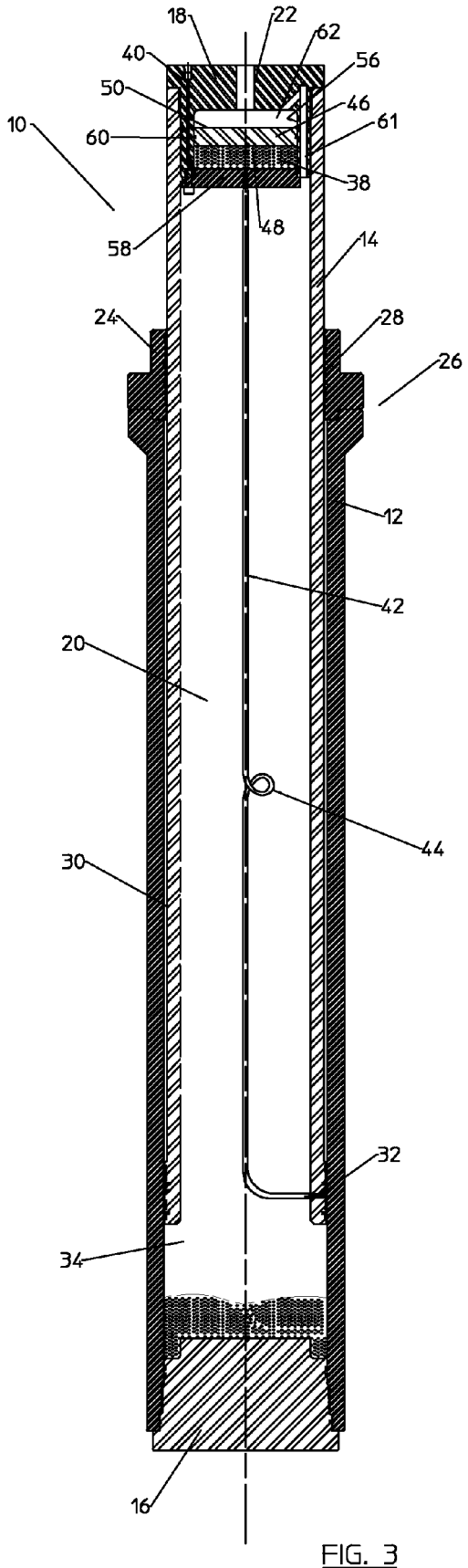
FIG. 3 is a cross sectional view of another cylinder for use in a riser tensioner, in accordance with an embodiment of the present disclosure.
Figure 4:
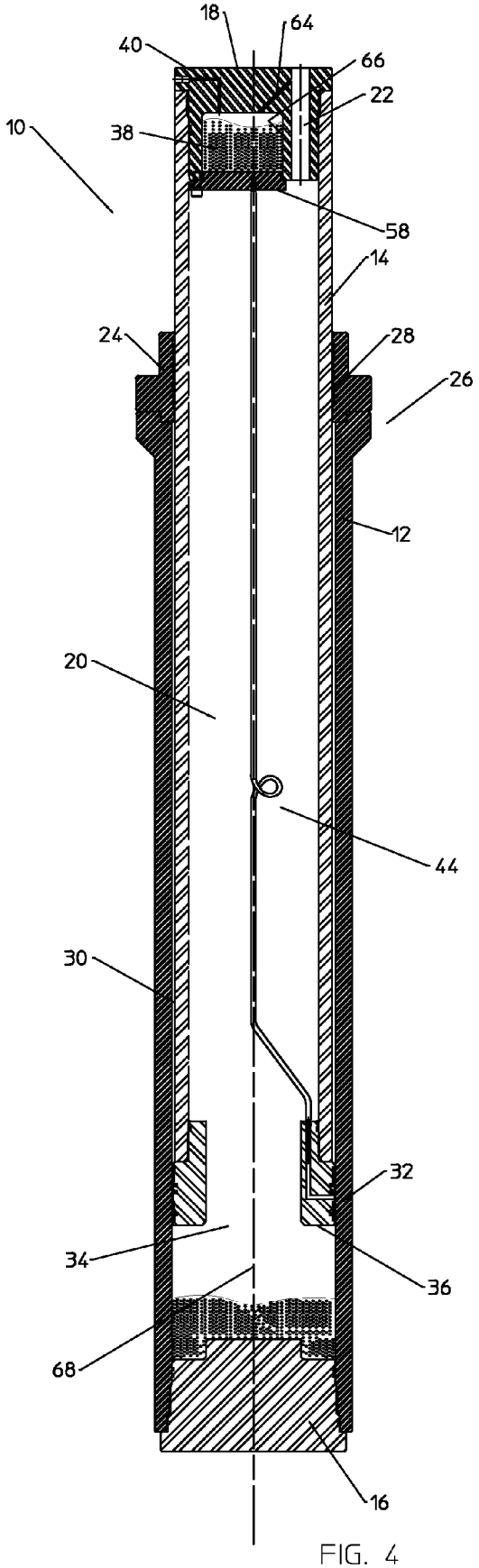
FIG. 4 is a cross sectional view of another cylinder for use in a riser tensioner, in accordance with an embodiment of the present disclosure.

The presently disclosed embodiments are directed to an improved riser tensioner cylinder 10 that can be used, for example, in the above described ram-style riser tensioner 110. FIGS. 2-4 illustrate different embodiments of the improved cylinder 10.

As described above, the cylinder 10 generally includes the outer cylinder barrel 12 and the inner rod barrel 14 (or piston barrel). In the illustrated embodiment, the inner rod barrel 14 is disposed within and extending upward from the outer cylinder barrel 12. The cylinder 10 may be closed at opposing ends via end caps (e.g., bottom cap 16 and top cap 18). For example, the outer cylinder barrel 12 may be closed at one end with the bottom cap 16, as illustrated. Similarly, the rod barrel 14 may be closed at the opposite end from the cylinder barrel 12 with the top cap 18. It should be noted that, in other embodiments, the arrangement of the outer cylinder barrel 12 and the inner rod barrel 14 may be reversed such that the inner rod barrel 14 is disposed within and extending downward from the outer cylindrical barrel 12. In such a case, the inner rod barrel 14 would be closed off by the bottom cap 16, and the outer cylinder barrel 12 would be closed off by the top cap 18.

The cylinder barrel 12 and rod barrel 14 are designed to slide relative to one another in response to changes in movement of a component (e.g., floating platform/structural frame 124 of FIG. 1) coupled to one side of the cylinder 10 relative to another component (e.g., riser 114 of FIG. 1) coupled to the opposite side of the cylinder 10. Throughout this stroking, the cylinder 10 may use a store of gas to apply a spring force for maintaining the desired tension on the riser coupled to the cylinder 10. As mentioned above, a volume 20 of gas inside the hollow cylinder barrel 12 and the rod barrel 14 may serve as the internal accumulator for the gas used to provide a spring force to the tensioner assembly. This volume 20 may be piped to and/or from an external accumulator (120 of FIGS. 1 and 5) through one or more ports 22. These ports 22 may form part of the above described manifold (122) for connecting the internal and external accumulators. These ports 22 may be disposed in the bottom cap 16 of the cylinder 10 or in the top cap 18 of the cylinder 10, depending on a desired external configuration for the cylinder 10.

The cylinder 10 may also include a cylinder flange 24 that attaches to an open end 26 (e.g., top end) of the cylinder barrel 12. The cylinder flange 24 may include a low pressure dynamic sealing arrangement 28 to close an annulus 30 between the cylinder barrel 12 and the rod barrel 14. A high pressure seal arrangement 32 is generally located near an open end 34 (e.g., bottom end) of the rod barrel 14 to separate high pressure and low pressure circuits. The "high pressure" circuit may refer to the internal volume 20 within the cylinder 10 along with the external gas accumulator (120), and the "low pressure" circuit may refer to the annulus 30 between the cylinder barrel 12 and the rod barrel 14 along with an external low pressure accumulator (not shown). The high pressure seals 32 may be installed either directly into the rod barrel 14 (FIGS. 2 and 3) or into a piston 36 that attaches to the rod barrel 14 (FIG. 4).

The presently disclosed cylinder assembly 10 includes a fluid reservoir 38 for holding lubricating fluid, and this fluid reservoir 38 may be disposed in an end cap of the cylinder 10. For example, as shown, the fluid reservoir 38 may be disposed in the top cap 18. In other embodiments, the fluid reservoir 38 may be disposed in the bottom cap 16. The reservoir 38 is used to maintain lubrication to the high pressure seals 32 between the cylinder barrel 12 and the rod barrel 14.

FIGS. 2-4 illustrate different embodiments of this cylinder design having the reservoir 38 disposed in the top cap 18. Each of these designs may include a fluid port 40 built through the top cap 18 to provide access to the fluid reservoir 38 in order to refill and perform other operations on the reservoir 38. In addition, each design may include a fluid communication tube 42 connecting the fluid supply in the reservoir 38 to the high pressure seal arrangement 32 at a lower point in the cylinder 10. As illustrated, the fluid communication tube 42 may include one or more loops 44 to increase the flexibility of the communication tube 42, allowing it to account for slight movements of the cylinder 10 or a piston (described below) under pressure.

In some embodiments, the cylinder 10 may include a piston 46 internal to the top cap 18, with lubrication fluid being on one side 48 of the piston and pressurized gas on the opposite side 50. This may help to maintain the fluid and the gas at approximately the same pressure. Such embodiments are illustrated in FIGS. 2 and 3.

In FIG. 2, for example, the port 22 for piping gas between the internal accumulator 20 of the cylinder 10 and the external accumulator (120) is disposed through the bottom cap 16. The piston 46 is positioned within and sealed against inner walls of the top cap 18. The fluid is disposed in the fluid reservoir 38 defined by one side 48 (top) of the piston 46, while the opposite side 50 (bottom) of the piston 46 may be entirely exposed to the volume 20 of gas within the hollow portion of the cylinder barrel 12 and rod barrel 14. In this arrangement, the pressurized gas may push upward on the piston 46 as the cylinder 10 is compressed. The piston 46 may in turn push fluid from the reservoir 38 into the fluid communication tube 42 and toward the high pressure seal arrangement 32 to lubricate the seal 32 being moved along the outer cylinder barrel 12.

In FIG. 3, the port 22 for piping gas between the internal accumulator 20 of the cylinder and the external accumulator (120) is disposed through the top cap 18. In this embodiment, a cylinder 56 may be formed into the top cap 18 and blocked at a bottom end by a fluid retention flange 58 that is fixed to the top cap 18. This arrangement may provide a relatively closed-off chamber 60 within the top cap 18 through which the piston 46 may move. One side 48 (bottom) of the piston may face the fluid reservoir 38 within the top cap 18, while the opposite side 50 (top) of the piston may be exposed to pressurized gas that is routed into the chamber 60 from the internal volume 20 in the main body of the cylinder 10 via a secondary port 61. The top cap 18 may also include the port 22 leading from a top side 62 of the chamber 60 to the external accumulator (120). In this arrangement, pressurized gas may be forced into the top side 62 of the chamber 60 as the cylinder 10 is compressed, thereby pressing downward on the piston 46. The piston 46 may force fluid from the fluid reservoir 38 into the fluid communication tube 42 and toward the high pressure seal arrangement 32 to lubricate the seal 32 being moved along the outer cylinder barrel 12.

In other embodiments, the cylinder 10 may not include a piston for pushing fluid into the fluid communication tube 42. Instead, as shown in FIG. 4, the cylinder 10 may include a pressure communication port 64 designed to maintain the fluid and gas of the cylinder 10 at approximately the same pressure, in order to force the fluid into the fluid communication tube 42. In this embodiment, the top cap 18 may feature a volume 66 formed therein and blocked at the bottom end by the fluid retention flange 58 fixed to the top cap 18, thereby providing a relatively closed-off fluid reservoir 38. The port 22 formed through the top cap 18 may not intersect the reservoir 38 formed in the top cap 18. Instead, the port 22 may route pressurized gas directly between the external accumulator (120) and the internal volume 20 of the cylinder 10. As illustrated, the reservoir 38 may be defined by an eccentric volume 66 formed in the top cap 18. That is, the reservoir 38 may be offset from a centerline 68 of the cylinder 10. This provides an adequate space for the port 22 used to communicate gas between the internal accumulator 20 and the external accumulator (120). It should be noted, however, that other arrangements of the reservoir 38 relative to the separate port 22 in the top cap 18 may be employed in other embodiments.

The pressure communication tube 64 may include a much smaller tube (relative to the port 22) disposed between the port 22 and an upper surface of the reservoir 38 to maintain a desired pressure in the reservoir 38. As the pressure from the pressure communication tube 64 increases due to compression of the cylinder 10, the increased pressure in the reservoir 38 may force the fluid into the fluid communication tube 42 and toward the high pressure seal arrangement 32 to lubricate the seal 32 being moved along the outer cylinder barrel 12.

By disposing the fluid reservoir 38 in the top cap of the cylinder 10, present embodiments may enable a relatively efficient use of space within the cylinder 10. The disclosed cylinders 10 may utilize relatively less lubricating fluid to maintain proper lubrication of the high pressure seal arrangement 32, compared to existing systems that fill an annulus between the barrels with fluid. By using a smaller volume for the fluid reservoir 38, the disclosed cylinder 10 may provide an increased volume 20 available for the internal accumulator. In addition, by storing the fluid in a reservoir 38 in the top cap 18, present embodiments may provide easier and more direct access to the reservoir 38 than would be available in designs having a reservoir positioned lower in the cylinder.

Although the present disclosure and its advantages have been described in detail, it should be understood that changes, substitutions and alterations can be made herein without departing from the spirit and scope of the disclosure as defined by the following claims.

What is claimed is:

1. A cylinder assembly for use in a riser tensioner, the cylinder assembly comprising:

an outer cylinder barrel;

an inner rod barrel disposed within the outer cylinder barrel and extending in a first direction from the outer cylinder barrel;

a first end cap coupled to and closing a first end of the outer cylinder barrel, wherein the first end is extending away from the inner rod barrel;

a second end cap coupled to and closing a second end of the inner rod barrel, wherein the second end is extending away from the outer cylinder barrel;

an internal volume of pressurized gas disposed within a hollow portion of the outer cylinder barrel and the inner rod barrel;

a high pressure seal disposed along a sliding interface between the inner rod barrel and an inner wall of the outer cylinder barrel; and a fluid reservoir for storing and communicating fluid from the fluid reservoir to the high pressure seal for lubricating the high pressure seal, wherein the fluid reservoir is disposed entirely within the first end cap or the second end cap.

2. The cylinder assembly of claim 1, further comprising a fluid port disposed in the end cap to provide access for refilling the fluid reservoir.

3. The cylinder assembly of claim 1, further comprising a port extending into the internal volume to facilitate communication of gas between the internal volume and an external accumulator.

4. The cylinder assembly of claim 3, wherein the port is disposed through an end cap coupled to an end of the inner rod barrel extending from the outer cylinder barrel or an end of the outer cylinder barrel extending away from the inner rod barrel.

5. The cylinder assembly of claim 3, further comprising a pressure communication port disposed between the port and an upper portion of the fluid reservoir to fluidly couple the port to the upper portion of the fluid reservoir.

6. The cylinder assembly of claim 1, further comprising a piston for maintaining the fluid reservoir at approximately the same pressure as the internal volume of pressurized gas.

7. The cylinder assembly of claim 6, wherein the piston is disposed directly between the internal volume of pressurized gas and the fluid reservoir.

8. The cylinder assembly of claim 6, further comprising a chamber, wherein the piston is disposed in the chamber, wherein the chamber is fluidly coupled to the internal volume of pressurized gas on a first side of the piston, and wherein the chamber comprises the fluid reservoir on the second side of the piston opposite the first side.

9. The cylinder assembly of claim 8, further comprising a port for facilitating communication of pressurized gas between the cylinder assembly and an external accumulator, wherein the port is coupled to the first side of the chamber.

10. The cylinder assembly of claim 1, further comprising a fluid communication tube coupled between the fluid reservoir and the high pressure seal and extending through the internal volume of pressurized gas.

11. The cylinder assembly of claim 10, wherein the fluid communication tube comprises a loop to enable further extension of the fluid communication tube.

12. The cylinder assembly of claim 1, wherein the fluid reservoir is an eccentric volume that is offset relative to a centerline of the cylinder assembly.

13. A method for operating a riser tensioner cylinder, comprising:

sliding an inner rod barrel relative to an outer cylinder barrel of the riser tensioner cylinder;

closing a first end of the outer cylinder barrel via a first end cap, wherein the first end is extending away from the inner rod barrel;

closing a second end of the inner rod barrel via a second end cap, wherein the second end is extending away from the outer cylinder barrel;

applying a spring force for maintaining a desired tension on a riser coupled to the riser tensioner cylinder via an internal volume of pressurized gas disposed within a hollow portion of the outer cylinder barrel and the inner rod barrel;

moving fluid from a fluid reservoir disposed in the riser tensioner cylinder to a high pressure seal between the inner rod barrel and the outer cylinder barrel, in response to an increased pressure of the pressurized gas in the internal volume, wherein the fluid reservoir is disposed entirely in the first or second end caps; and lubricating the high pressure seal via the fluid.

14. The method of claim 13, further comprising refilling the fluid reservoir via a fluid port extending through the end cap into the fluid reservoir.

15. The method of claim 13, further comprising supplying fluid to the high pressure seal in response to pressurized gas in the internal volume via a piston.

16. The method of claim 13, further comprising routing pressurized gas from the internal volume into a first side of a chamber disposed in the riser tensioner cylinder, pushing a piston from the first side of the chamber to a second side of the chamber having the fluid reservoir, and pushing the fluid from the fluid reservoir to the high pressure seal.

17. The method of claim 13, further comprising routing pressurized gas from the internal volume into an upper portion of the fluid reservoir.

18. The method of claim 13, further comprising facilitating communication of gas between the internal volume and an external accumulator via a port extending into the riser tensioner cylinder.

19. The method of claim 13, wherein moving fluid from the fluid reservoir to the high pressure seal comprises communicating the fluid from the fluid reservoir to the high pressure seal via a fluid communication tube extending through the internal volume.

* * * * *